United States Patent [19]

Motoyama et al.

[11] Patent Number: 4,707,675

[45] Date of Patent: Nov. 17, 1987

[54] ELECTROMAGNETIC RELAY

[75] Inventors: Masanori Motoyama, Matsusaka; Toyotaka Nishikawa; Masashi Nakagawa, both of Mie, all of Japan

[73] Assignee: Matsushita Electric Works, Ltd., Japan

[21] Appl. No.: 845,634

[22] Filed: Mar. 28, 1986

[30] Foreign Application Priority Data

May 20, 1985 [JP] Japan ..... 60-108546

[51] Int. Cl.[4] ..... H01H 63/02; H01H 67/02

[52] U.S. Cl. ..... 335/130; 335/128; 335/131; 335/133; 335/202

[58] Field of Search ..... 335/125, 127, 128, 129, 335/130, 133, 135, 201, 202, 203, 131

[56] References Cited

U.S. PATENT DOCUMENTS

| | | | |
|---|---|---|---|
| 3,109,903 | 8/1960 | Lychyk | 335/125 |
| 4,101,856 | 7/1978 | Durr | 335/135 |
| 4,302,742 | 11/1981 | Schedele | 335/202 |
| 4,339,735 | 7/1982 | Ono | 335/119 |
| 4,613,840 | 9/1986 | Yabu et al. | 335/129 |

FOREIGN PATENT DOCUMENTS

| | | | |
|---|---|---|---|
| 0049088 | 4/1982 | European Pat. Off. | 335/129 |

*Primary Examiner*—E. A. Goldberg

*Assistant Examiner*—Lincoln Donovan

*Attorney, Agent, or Firm*—Stevens, Davis, Miller & Mosher

[57] ABSTRACT

An electromagnetic relay includes a base of electrically insulation for mounting an electromagnet, an armature and at least one contact assembly including a movable contact. Integrally molded with the base is an envelope having side walls and a top wall for receiving therein the electromagnet which envelope defines on the base outwardly thereof a space for mounting the contact assembly. The side wall of the envelope extends along the entire length of the electromagnet in order to completely separate the contact assembly located outwardly of the envelope from the electromagnet along the entire length thereof for increased insulation resistance therebetween. The armature is mounted on the top wall of the envelope to be movable within a horizontal plane on the top wall and is operatively connected to the movable contact of the contact assembly by a card extending over the side wall adjacent thereto. The electromagnet, contact assembly and armature are arranged in dense-packed manner on the base while the electromagnet is effectively insulated by the envelope from the contact assembly, whereby assuring higher current carrying capacity with a miniaturized construction of the relay.

9 Claims, 12 Drawing Figures

ELECTROMAGNETIC RELAY

BACKGROUND OF THE INVENTION

1. Field of the invention

The present invention relates to an electromagnetic relay, and more particularly to a low profile miniature electromagnetic relay having a base with an integrally molded enclosure for receiving therein an electromagnet and insulatively separating the same from a contact assembly mounted on the base outwardly of the enclosure.

2. Description of the prior art Electromagnetic relays, particularly relays requiring a higher contact rating within a small-sized casing are known to have a partition wall dividing the interior of a relay casing into two spaces, one for mounting an electromagnet and the other for a contact assembly. The relay construction having the above partition for separating the electromagnet from the contact assembly becomes more essential for designing a miniature relay in which components are dense-packed with a maximum insulation resistance between the electromagnet and the contact assembly. Prior relays having the above partition are disclosed, for example, in U.S. Pat. Nos. 4,101,856, 4,302,742, and 4,339,735, in all of which the partition extends along the length of the electromagnet for separation thereof from the contact assembly. However, all the partitions employed in each prior art relay must have a slot or opening within its length for passing therethrough a card or like actuating member which operatively connects the electromagnet to the contact assembly in order to actuate the switching operation of the contact assembly in response to the energization of the electromagnet. Unfortunately, due to the slot or opening formed in the partition, the partition fails to achieve complete insulation between the contact assembly and the electromagnet within the entire length of the electromagnet, and therefore the slot or opening is likely to form between the electromagnet and the contact assembly a shortcut leakage path through which a possible arcing originating from the contact assembly may extend to and damage the electromagnet. With the partition of the prior relays, therefore, the electrical insulation is interrupted at a portion of the partition so as to considerably reduce the effectiveness of the partition and only provide an unsatisfactory insulation effect, which is a hindrance to designing a miniature relay having a high contact rating in which magnetic and electric components are required to be dense-packed at a maximum insulation resistance.

One solution to the above problems is proposed in U.S. patent application Ser. No. 800,393 filed on Nov. 21, 1985 assigned to the assignee of the present invention in which a relay casing is divided by an insulative partition into a coil space for receiving an electromagnet and a switching space for receiving a contact assembly. While the relay of this application ensures effective insulation between the electromagnet and the contact assembly due to the employment of the insulative partition extending along the entire length of the electromagnet, there remains problems in that the electromagnet and the contact assembly are vertically arranged one above the other to result in increased height and that an armature extends across the electromagnet and the contact assembly at one longitudinal end of the relay casing to result in increased length of the relay. The above problems are less critical when the relay is designed to have a width as small as possible with little attention to the length and height of the relay. However, the problems attendant with the above relay construction becomes more critical when the relay is required to be manufactured at a minimum length and height for particular purposes.

SUMMARY OF THE INVENTION

The present invention has been accomplished in view of the above problems and provides improved features for attaining a miniature relay with reduced height and length dimensions ensuring satisfactory insulation between an electromagnet and a contact assembly. The relay in accordance with the present invention comprises a mount base of electrically insulative material with an integrally molded envelop having a top wall, side wall, and a rear end wall. The insulation envelop receives therein an electromagnet and defines on the base outwardly thereof a space for mounting at least one contact assembly including a movable contact. An armature is mounted on the top wall of the envelope to be movable within a plane parallel to the plane of the base. The armature is magnetically coupled to the electromagnet for movement in response to the energization thereof. Formed with the armature is a card of electrically insulative material which extends over the side wall of the envelop for coupling with the movable contact of the contact assembly so that the movable contact is actuated in its switching operation upon the energization of the electromagnet. The side wall adjacent to the contact assembly extends along the entire length of the electromagnet without leaving any direct communication path therebetween so as to completely separate the electromagnet from the contact assembly. Thus, the whole length of the electromagnet can be successfully insulated from the contact assembly by the side wall so as to assure satisfactory insulation therebetween, eliminating the formation of any shortcut leakage path extending through the side wall. This is advantageous particularly for a miniature relay having a high contact rating where no extra space is available for insulation purposes. With this result, the electromagnet and the contact assembly can be effectively insulated while they are disposed in such a side-by-side relationship as to maintain the height of the relay at a minimum dimension. Also, the card of the armature extending over the side wall for connection with the movable contact can be within the length of the contact assembly, requiring no extra length for the connection between the armature and the contact assembly and contributing to keep the length of the relay at a minimum dimension.

Accordingly, it is a primary object of the present invention to provide an electromagnetic relay which assures maximum insulation resistance between the electromagnet and the contact assembly to have an increased current carrying capacity, yet enabling it to be made compact, particularly with respect to the height and length dimensions.

In preferred embodiments of the present invention, the electromagnet includes a coil bobbin around which a coil is wound. The coil bobbin is provided at its end with a laterally extending flange which carries coil terminals for the coil. Formed at the front end of said envelop is an insulation lip which extends laterally outwardly from the front end portion of the side wall adjacent to said contact assembly and which forms on its front a recess for receiving therein said flange carrying the coil terminal. Thus, the coil terminals carried on the flange of the coil bobbin are completely separated ty the insulation lip from the contact assembly in order to be effectively insulated therefrom.

It is therefore another object of the present invention to provide an electromagnetic relay in which the coil terminals mounted on the side of the electromagnet can be well insulated from the contact assembly, further improving the insulation between the contact assembly and the electromagnet including the coil terminals.

The envelop has at its front end a mouth through which the electromagnet is inserted into the envelop. Said insulation lip extends outwardly laterally from each of the side wall of the envelop to define on its front said recess for receiving the flange of the coil bobbin. The electromagnet includes a U-shaped yoke with parallel legs connected at their end by a web and a core joining at its one end to the web of the yoke to extend between the legs of the yoke in parallel relation thereto, the free end of each leg of the yoke being spaced from the other end of the center core so as to define therebetween a gap into which a pole piece of said armature extends through a window in the rear end of the top wall of the envelop in order to magnetically couple the armature to the electromagnet. The outer face of each leg being kept in intimately contacting engagement with the inner surface of the adjacent side wall of the envelop such that the legs of the yoke are prevented from spreading outwardly to maintain said gap at a predetermined distance. This is effective for stably holding the gap distance against the force which may be applied to the yoke by the armature during its switching operation, which in turn assures accuracy for the armature movement and for the contact switching operation.

It is therefore a further object of the present invention to provide an electromagnetic relay in which the gap distance of the yoke is stably maintained to provide a highly reliable relay operation.

In a preferred embodiment of the present invention, an additional coil terminal is cooperative with the coil terminals held on the flange of the coil bobbin for two-coil wiring arrangement of the electromagnet, one coil for a set coil and the other for a reset coil. The additional coil terminal is received within an indent formed in the front surface of said insulation lip in such a way as to be insulatively separated from the contact assembly mounted behind the insulation lip. In this way, the additional coil terminal employed for the two-coil system can be likewise separated from the contact assembly to maintain effective insulation between all of the coil terminals and the contact assembly, which is therefore a further object of the present invention.

The relay of the present invention further includes a cover of electrically insulative material which fits over the armature and the contact assembly on the relay base. Formed on the relay base is support wall means which extends upwardly above the armature to be in supporting contact with the ceiling of the case. The upper end of the support wall means terminates at a position above the armature to leave between the top wall of the enclosure and the ceiling of the case a header space within which the armature can move without being interfered with the casing.

It is therefore a further object of the present invention to provide an electromagnetic relay in which the cover can be successfully added to the relay base without interrupting the movement of the armature.

In another embodiment of the present invention, the relay is constructed to have a single contact assembly on one side of the enclosure. The contact assembly includes a movable contact in the form of an elongate spring which is connected to the card of the armature to be driven thereby for making the switching operation with the fixed contact. The armature is pivotally mounted on the top wall of the enclosure for pivotal movement about a pivot axis within a horizontal plane on the top wall of the envelop. Said pivot axis of the armature is arranged to be on the extension of the length of the movable spring so that the connection between the card and the movable spring is aligned along the length thereof with the pivot axis. With this arrangement, the pivotal movement of the armature bring little amount of sliding movement of the card with respect to the movable spring and maintaining the amount of such sliding at a minimum. Thus, the armature is connected to the contact assembly in such a manner as to reduce as much as possible the amount of friction between the card and the movable spring upon the pivotal movement of the armature, which is most advantageous feature for obtaining the relay with a higher response sensitivity.

It is therefore a further object of the present invention to provide an electromagnetic relay which has a higher response sensitivity.

The present invention further discloses other advantageous features such as for preventing the bouncing of the movable spring to rapidly interrupt possible arcing developed between the contacts, and for enhancing the insulation between the electromagnet and the contact assembly by utilization of a part of the cover.

These and other objects and advantages of the present invention will become more apparent from the following description of the preferred embodiments when taken in conjunction with the attached drawings.

DESCRIPTION OF THE PREFERRED EMBODIMENTS

Figure 1:
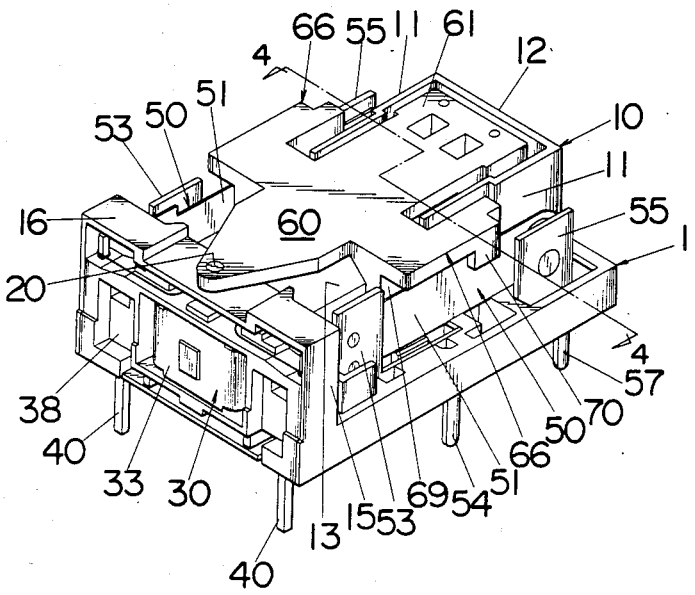
FIG. 1 is a perspective view of an electromagnetic relay in accordance with a first embodiment of the present invention.

Referring now to FIGS. 1 to 8, there is shown an electromagnetic relay in accordance with a first embodiment of the present invention. The relay comprises a base 1 for mounting an electromagnet 30, a pair of contact assemblies 50, and an armature 60. The base 1 is made of electrically insulative plastic material to include an integrally molded enclosure 10 extending along the substantial length of the base 1 and leaving on both sides thereof spaces respectively for mounting the contact assemblies 50. The enclosure 10 has a bottom wall common to the base 1 and is defined by a pair of parallel side walls 11, a rear end wall 12 and a top wall 13. The enclosure 10 is opened at its front end to define thereat a mouth 14 through which the electromagnet 30 is assembled into the enclosure 10. Integrally extending laterally from the front edge of each side wall is an insulation lip 15 which terminates at the side extremity of the base 1 to close the front end of said space for mounting the contact assembly 50. A rim 16 extends integrally along the front edges of the top wall 13 and the insulation lips 15 to define on the front of the enclosure 10 or insulation lips 15 a recess 17. A cover 5 of like insulative material fits on the base 1 to enclose therebetween the contact assemblies 50 and the armature 60.

Figure 2:
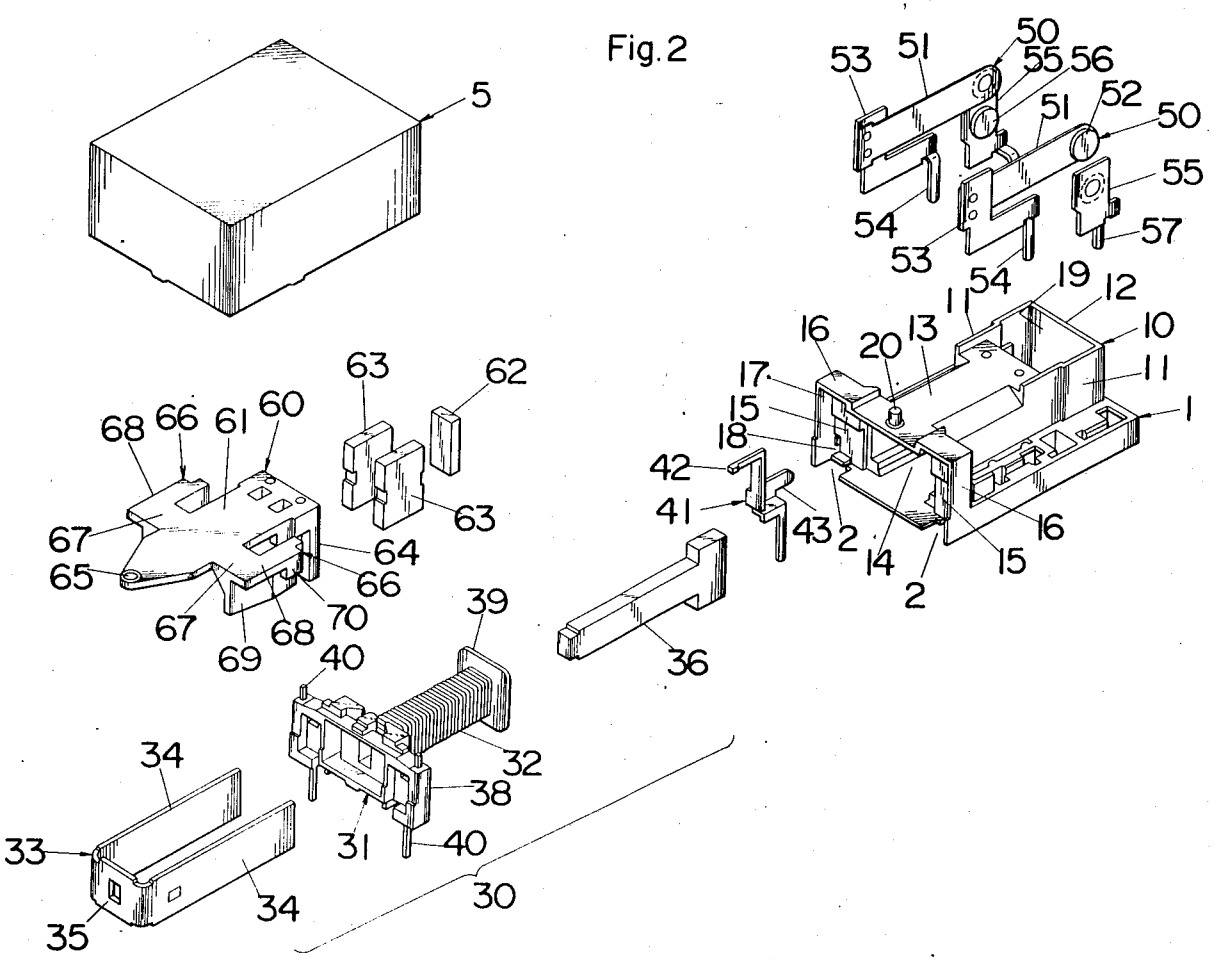
FIG. 2 is an exploded perspective view of the above relay.
Figure 3:
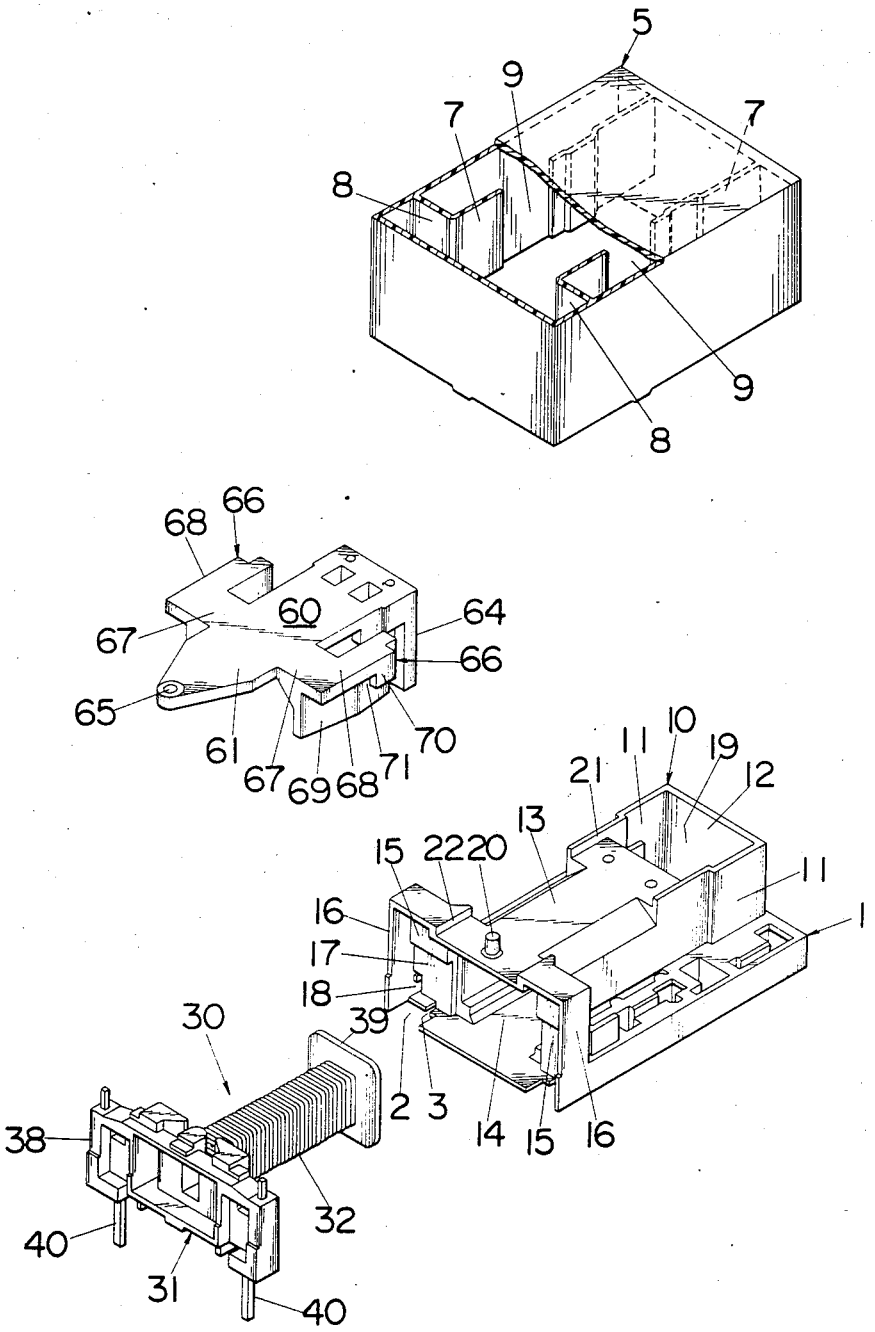
FIG. 3 is an exploded perspective view of the above relay with its contact assemblies removed.
Figure 6:
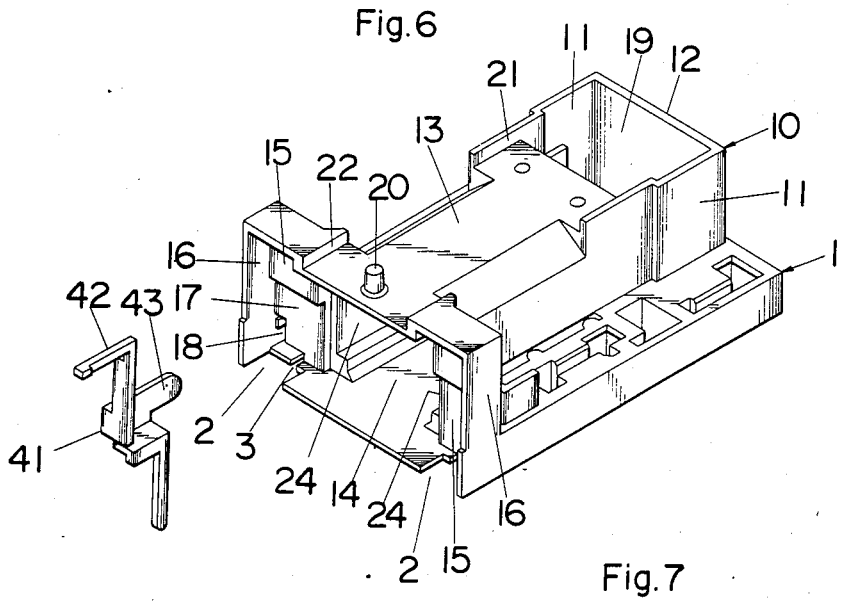
FIG. 6 is an exploded perspective view of the relay base and an additional coil terminal to be embeded therein.

In the present embodiment, the electromagnet 30 is of the two-coil type having a set coil and a reset coil, each passing a current of the opposite direction for reversing the switching operation of the contact assemblies 50. As best shown in FIG. 2, the electromagnet 30 comprises a coil bobbin 31 around which the set and reset coils 32 are wound, a U-shaped yoke 33 with parallel legs 34 joined by a web 35, and a core 36 which extends through coil bobbin 31 and connected at its end to the web 35. The core 36 extends in parallel relation with the yoke legs 34 so that a gap is defined between the other end thereof and the free end of each yoke leg 34. The coil bobbin 31 is molded of an electrically insulative plastic material to have at its front end a laterally extending flange 38 through which the yoke legs 34 extend rearward with the web 35 being held therein. The flange 38 is dimensioned so as to be snugly fitted within said recess 17 at the front end of the enclosure 10 and carries two coil terminals 40 respectively at the lateral end portions. Each of the coil terminals 40 embeded in the flange 38 has its upper end connected to the one end of each of the set and reset coils 32 and has its lower end or lug portion extending downwardly through a notch 2 in the front edge of the base 1 for connection with external control circuits. A separate coil terminal 41 is supported to one of said insulation lips 15 to have its upper end 42 connected to the common end of the set and reset coils. As best shown in FIG. 6, the coil terminal 41 is fixed in position with its middle portion including a rearward tab 43 being inserted into an indent 18 formed in the front surface of said insulation lip 15. The lower end or lug portion of the coil terminal 41 extends downwardly through a slit 3 continuous with said notch 2 of the base 1 for connection with the external control circuits. The indent 18 is only opened at its front end for insertion of the coil terminal 41 and does not constitute any communication path with the space behind the insulation lip 15 so that the coil terminal 41 is completely separated from the contact assembly 50 mounted rearwardly of the insulation lip 15 as in the same fashion that the coil terminals 40 on the flange 38 of the coil bobbin 31 are insulated therefrom by the insulation lips 15.

Each of the contact assemblies 50 comprises a movable contact 51 in the form of an elongate leaf spring and a fixed contact 55. The movable contact or spring 51 extends alongside of the envelop 10 with its one end supported by a terminal plate 53 fixed on the base 1 just behind the insulation lip 15 and has on the other end a contact tip 52 engageable with a contact tip 56 on the fixed contact 55 at the rear end of the base 1. The terminal plate 53 and the fixed contact 55 are provided respectively with lugs 54 and 57 which extends downwardly through the base 1 to form respective contact terminals.

Figure 7:
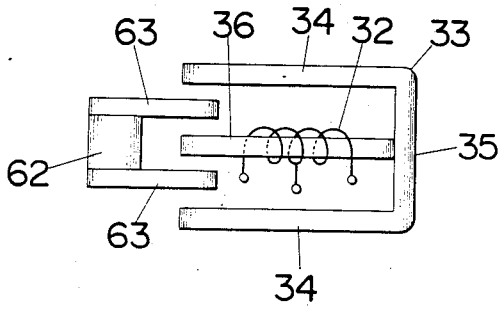
FIG. 7 is a schematic illustration of the magnetic coupling between an electromagnet and an armature of the above relay.

The relay of the present embodiment is of polarized type incorporating a permanent magnet 62 in the armature 60. The armature 60 comprises a flat-shaped swing plate 61 of an electrically insulative plastic material provided on the underside of its rear end with pole means, which is composed of a pair of pole pieces 63 magnetized to have opposite polarity by the permanent magnet 62 interposed between the same end of the pole pieces 63. The permanent magnet 62 and the pole pieces 63 are embeded in a depending frame 64 at the rear end of the swing plate 61 in such a way that the major portions of the pole pieces 63 project on the underside of the swing plate 61. Formed in the rear end of the top wall 13 of said envelop 10 is a window 19 through which the pole means thus constructed extends into the enclosure 10 where it is magnetically coupled to the pole end of the electromagnet 30. That is, as schematically shown in FIG. 7, each of the pole pieces 63 extends into a gap defined between the free ends of the core 36 and each of the yoke legs 34 so as to be movable within the gap upon energization of the set and reset coils 32.

Figure 8:
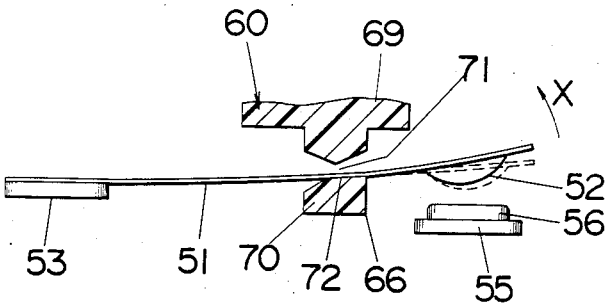
FIG. 8 is a schematic illustration of the connection between a movable spring and a card of the armature employed in the above relay.

Turning back to FIGS. 1 through 3, the swing plate 61 of the armature 60 has in its front end a bearing hole 65 which receives a pivot pin 20 on the front end of the top wall 13 so that the armature 60 is pivotally supported on the top wall 13 and pivots about the pivot pin 20 within a horizontal plane on the top wall 13 of the enclosure upon energization of the coils. Integrally formed on either side of the swing plate 61 is a card 66 which extends over the adjacent side wall 11 of the enclosure 10 so as to catch the movable contact 51 of each contact assembly 50 for actuation thereof upon the pivotal movement of the armature 60. Each of the cards 66 is generally L-shaped as viewed in a horizontal plane composed of a first leg 67 in perpendicular relation to the length of the armature 60 and a second leg 68 in parallel relation thereto. Formed on the underside of the second leg 68 is an integral skirt 69 which depends along the inner edge thereof in spaced relation with a complementary flap 70 depending from the outer edge of the free end portion of the second leg 68 so as to define therebetween a slot 71, as best shown in FIG. 8. It is this slot 71 that catches the intermediate portion of the movable spring 51 for actuation thereof by the pivotal movement of the armature 60.

In operation, when the electromagnet 30 is energized by flowing a current of given polarity through the set coil, the armature 60 is driven to pivot in one direction at which occurrence one of the card 66 actuates the corresponding movable contact or spring 51 against the bias thereof into contacting engagement with the fixed contact 55 for closing the contacts of the contact assembly 50 on one side of the base 1 and simultaneously the other card 66 actuates the corresponding movable spring 51 against the bias thereof out of contacting engagement from the fixed contact 55 for contact breaking of the contact assembly 50 on the opposite side of the base 1. In this sense, the former contact assembly 50 assumes a normally-open contact while the latter assumes a normally-closed contact which is opened in so-called lift-off fashion by the card 66 of the armature 60. When the electromagnet 30 is magnetized to the opposite polarity by the current flowing through the reset coil, the armature 60 is driven to pivot in the opposite direction, thus reversing the switching operation of the contact assemblies 50.

Figure 4:
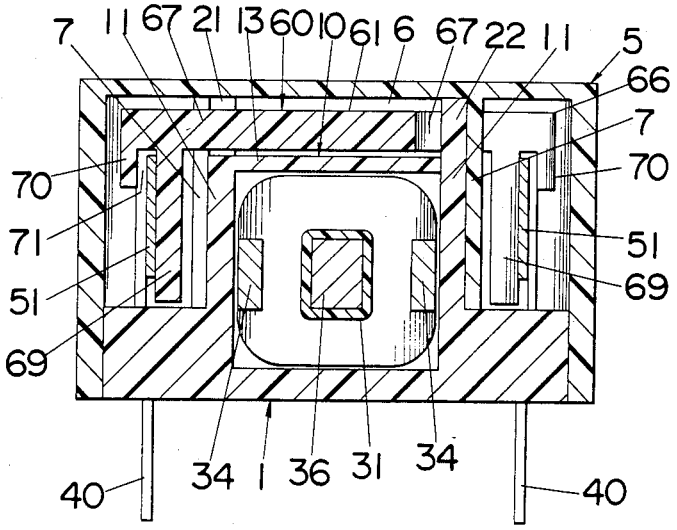
FIG. 4 is a cross section of the above relay with a cover attached, taken along a corresponding line 4—4 of FIG. 1.

The rear end portion of the envelop 10 is formed with an upward extension 21 along the upper edges of the rear end wall 12 and the side wall 11, which extension 21 is cooperative with the like upward extensions 22 on the insulation lips 15 at the front end of the enclosure 10 to define support wall means the upper end of which terminates in a horizontal plane upwardly of said armature 60 and serves to support the ceiling of the cover 5, whereby leaving between the top wall 13 of the enclosure 10 and the ceiling of the cover 5 a header space 6 within which said armature 60 can move free from collision with the cover 5, as best shown in FIG. 4. Formed interior of the cover 5 are a pair of partitions 7 each extending from the rear face thereof in spaced relation with the side face and joining by a bent portion 8 with the side face just behind the front face. In the assembled state of the cover 5 onto the base 1, each partition 7 extends between the contact assembly 50 and the adjacent side wall 11 of the enclosure 10 in an overlapping manner on the side wall 11 so as to further improve the electrical insulation of the contact assembly 50 from the electromagnet 30 as well as from the pole means of the armature 60 exposed in the window 19 at the rear end of the top wall 12 of the enclosure 10. That is, the partition 7 can serve to substantially close the window 19, which is inevitable for magnetic coupling between the armature 60 and the electromagnet 30, in such a way as to effectively insulate the electrically conductive parts of the electromagnet 30 and the armature 60 from the contact assemblies 50. The partition 7 is formed in its intermediate portion of its length with an aperture 9 which allows the first leg 67 of the card 66 to extend therethrough for coupling with the movable contact 51. It is noted at this time that said skirt 69 depending from the second leg 68 of the card 66 is in overlapping relation with the aperture 9 so as to substantially close the same. The above structure, in addition to the arrangement that the aperture 9 is offset lengthwise from the window 19, can certainly reduce to a maximum extent the formation of communication path from the contact assembly 50 to the electrically conductive parts of the electromagnet 30 and the armature 60 through the window 19. Said bent portion 8 of each partition 7 overlaps over the corresponding insulation lip 15 just behind the same so as to ensure the separation between the contact assembly 50 and the coil terminals 40 and 41 received in the recess 17 at the front end of the envelop 10.

Figure 5:
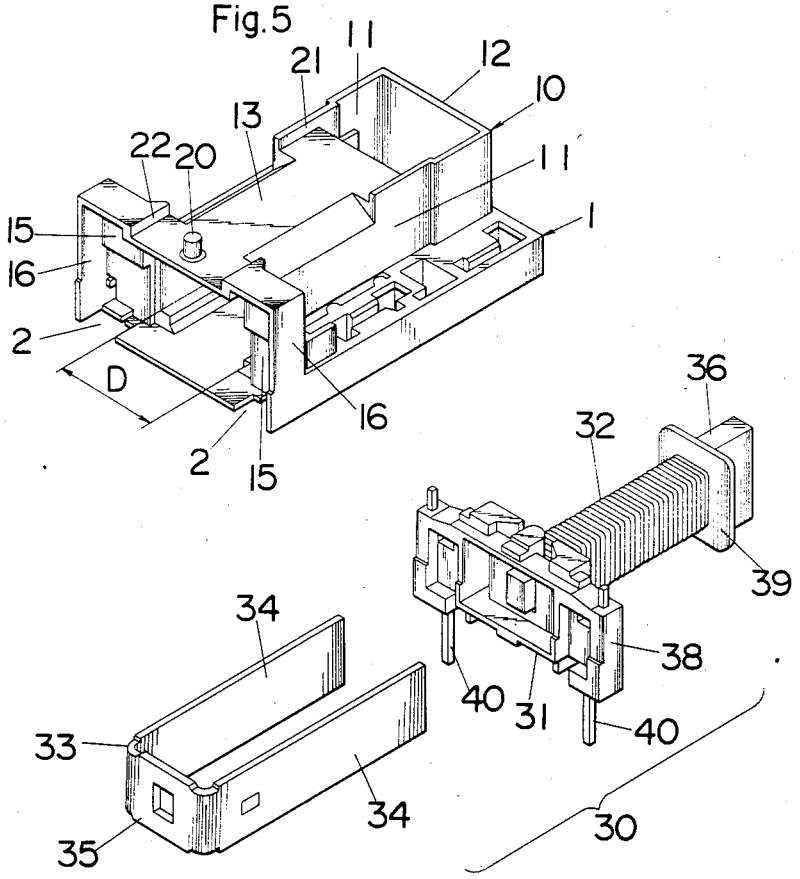
FIG. 5 is an exploded perspective view of a relay base, coil bobbin and a yoke constructing the above relay.

Referring to FIGS. 5 and 6, the enclosure 10 is formed in the inner surface of each side wall 11 with a furrow 24 into which each of the yoke legs 34 of the electromagnet 30 is slid at the assembling of the relay. The height of the furrow 24 is dimensioned to equal that of each yoke leg 34 so that the yoke legs 34 are snugly fitted on the inner surface of the side walls 11 to be fixed in position. The inner distance D between the opposed side walls 11, or the furrows 24 is dimensioned to be exactly equal to the outer distance between the opposed yoke legs 34 in order that the yoke legs 34 are kept in intimately contacting engagement with the inner surfaces of the side walls 11, or the bottoms of the furrows 24. This is a safty measure against possible deformation of the yoke legs 34 due to the force which may be applied thereto each time the pole piece 63 of the armature 60 strikes the yoke leg 34 during the pivotal movement of the armature 60. Otherwise, the yoke legs 34 would be caused to spread outwardly by the repetitive application of such force over a long period of the relay operation. This is also effective for stably maintaining the gap distance between the core 36 and each of the yoke legs 34, thus effecting the accuracy with which the armature 60 can pivot for actuating the switching operation of the contact assemblies 50 and therefore increasing response sensitivity. For the same purpose, a rear flange 39 which is provided at the rear end of the coil bobbin 31 to support the free ends of the yoke legs 34 on both side thereof has exactly the same width as the inner distance between the opposed yoke legs 34. Although the present embodiment only illustrates the electromagnet 30 with the set and reset coils, however, an electromagnet 30 with a single coil may be of course employed.

As shown in FIG. 8, one of the cards 66 coupled with the movable spring 51 forming the normally-closed contact arrangement is configured to have a flat portion 72 on one of the opposed faces of the slot 71 receiving the movable spring 51, which flat portion 72 is in face-to-face contacting engagement with the portion of the length of the movable spring 51, while the other face is in a point contacting relation with the movable spring 51 with respect to the length thereof. Said flat portion 72 terminates at a rear edge of the card 66 and provides a face-to-face contact between the rear end of the card 66 and the movable spring 51, such that when the armature 60 actuates the movable spring 51 in the direction (indicated by an arrow X) of disengaging it from the fixed contact 55 against the bias of the spring in the so-called lift-off manner, the movable spring 51 can effectively and rapidly cease its vibration associated with the abrupt movement of the movable spring 51 from the stable position of closing the contacts, thus preventing the bouncing of the contacts and ensuring rapid interruption of possible arc developed between the contacts.

Also, the above description is only directed to the relay of bistable operation in which the yoke legs 34 establish with the adjacent ones of the pole pieces 63 the magnetic paths of the same magnetic resistance so that the armature 60 is stable at either of its positions as one of the pole pieces 63 is kept attracted to the corresponding yoke leg 34 by the action of the permanent magnet 62, however, it is equally possible to provide a relay of monostable operation by differentiating the magnetic resistance of the magnetic paths between the yoke legs 34 and the corresponding pole pieces 63 of the armature 60.

Figure 9:
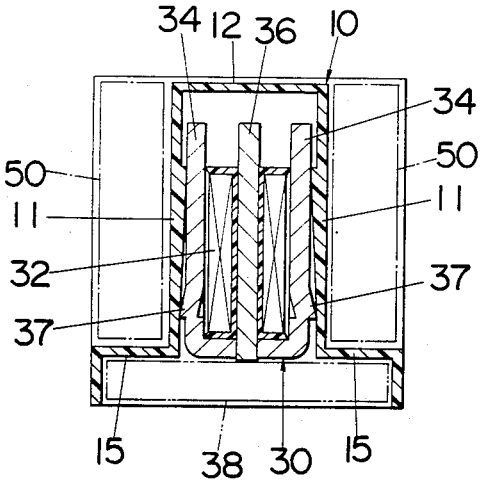
FIG. 9 is a horizontal section, in somewhat schematic representation of a relay in accordance with the modification of the above relay.
Figure 10:
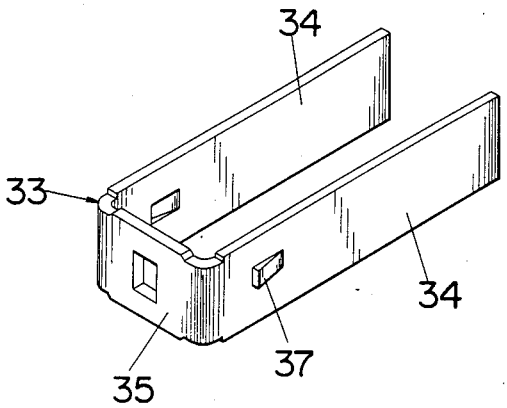
FIG. 10 is a perspective view of a yoke employed for the relay of FIG. 9.

Referring to FIGS. 9 and 10, there is shown a modification of the first embodiment which is identical in construction thereto except for the detailed configurations of the yoke legs 34 and the corresponding side walls 11 of the enclosure 10. The inner width between the opposed side walls 11 of the enclosure 10 is wider at the front end than at the rear end for facilitating the molding of the enclosure 10 as well as insertion of the electromagnet 30 into the enclosure 10. The width at the rear end of the enclosure 10 is dimensioned so that the rear end portion of each yoke leg 34 is in intimate engagement with the side wall 11 for providing an accurate positioning of the yoke legs with respect to the armature 60 to assure accurate movement of the armature 60 in much the same way as in the previous embodiment. The yoke 33 is formed to have on the front end portion of each leg 34 a protrusion 37 which is struck outwardly therefrom for engagement with the front widened portion of the side wall 11 for stably fixing the electromagnet 30 within the envelop 10.

Figure 11:
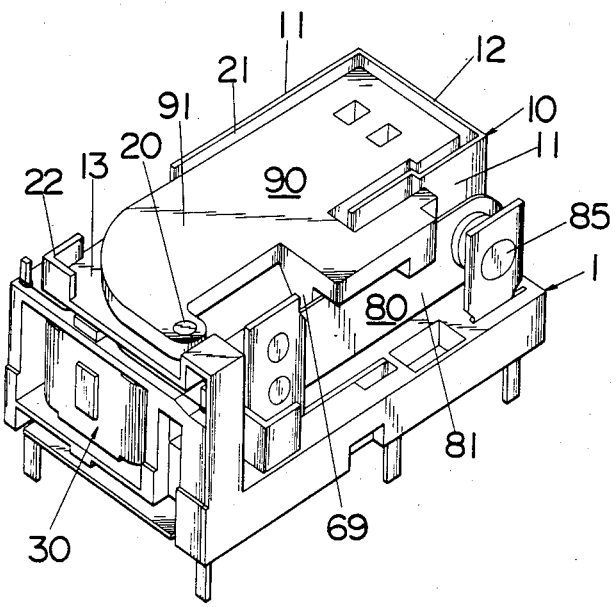
FIG. 11 is a perspective view of an electromagnetic relay in accordance with a second embodiment of the present invention.
Figure 12:
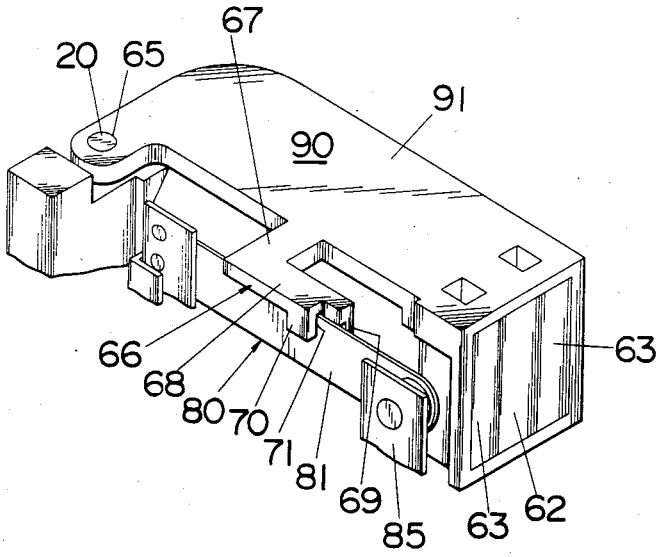
FIG. 12 is partial view, in perspective representation, of the relay of FIG. 11.

Referring to FIGS. 11 and 12, there is shown a relay in accordance with a second preferred embodiment of the present invention which is similar in construction to the above first embodiment except that it includes only a single contact assembly 80 on one side of a relay base 1 including an enclosure 10 of substantially the same configuration as in the first embodiment. Like numerals designate the like parts for easy understanding. Mounted on the top wall 13 of the enclosure 10 is an armature 90 which comprises a flat swing plate 91 of electrically insulative plastic material carrying on the underside of its rear end pole means likewise composed of the pole pieces 63 and the permanent magnet 62 interposed therebetween. The armature 90 is magnetically coupled with the electromagnet 30 received within the enclosure 10 by the pole means extending into the enclosure 10 so that it is movable upon energization of the electromagnet 30 within a horizontal plane on the top wall 13 about the pivot pin 20 projected on the front end of the top wall to extend into the complementary bearing hole 65 in the front end portion of the swing plate 91.

Projecting from the lateral side of the armature 90 is card 66 of like construction having first leg 67, second leg 68, skirt 69, flap 70, and slot 71 for engagement with the movable spring 81 of the contact assembly 80. The pivot axis of the armature 90 or the pivot pin 20 is arranged on the extension of the length of the movable spring 81 extending alongside the envelop 10 so that the pivot axis is in alignment with the connection between the card 66 and the movable spring 81 along the length of the movable spring 81, whereby the pivotal movement of the armature 90 causes little or substantially no friction of the card 66 along the length of the movable spring 81 as opposed to the case in which the pivot axis of the armature is offset laterally from the extension of the movable spring 81. With this result, the relay of the present embodiment can have an increase response sensitivity. In operation, the armature 90 is urged in one direction by the bias of the movable spring 81 and is pivoted in the other direction upon energization of the electromagnet 30 to drive the movable spring 81 into contact with a fixed contact 85 against the bias of the movable spring 81. It is to be noted at this time that a cover (although not shown in the figures) of a like construction as in the first embodiment is adapted to fit over the relay base 1 so that the relay of the second embodiment can also enjoy an increased insulation effect between the electromagnet 30 and the contact assembly 80 in much the same way as in the first embodiment. In the present embodiment, there is only disclosed the contact assembly 80 of normally-open switching arrangement, however, it is of course possible to include a contact assembly of normally-closed switching configuration instead. In this event, the card could be connected with the movable spring in the like manner described with reference to FIG. 8.

What is claimed is:

1. An electromagnetic relay comprising:

a mount base of electrically insulative material provided with an integrally molded enclosure having a top wall and side walls, said top wall and side walls cooperating with a portion of the mount base to define said enclosure as being of a tunnel-like configuration contiguous around its periphery;

at least one contact assembly mounted on the base outwardly of the enclosure adjacent the side wall thereof, said contact assembly including a movable contact;

an electromagnet received within the enclosure, said electromagnet having a coil means the entire length of which is completely surrounded by said enclosure to be thereby insulated from the contact assembly;

an armature which is mounted on the top wall of the enclosure to be movable within a plane parallel to the plane of the base and which is magnetically coupled to the electromagnet for movement in response to the energization of the electromagnet; and said armature being provided with at least one card of electrically insulative material which extends sideward over the adjacent side wall of the enclosure to be connected to the movable contact such that the movable contact is driven by the armature for making the switching operation thereof upon energization of the electromagnet.

2. An electromagnetic relay comprising:

a mount base of electrically insulative material provided with an integrally molded enclosure having a top wall and side walls, said top wall and side walls cooperating with a portion of the mount base to define said enclosure as being of a tunnel-like configuration contiguous around its periphery;

at least one contact assembly mounted on the base outwardly of the enclosure adjacent the side wall thereof, said contact assembly including a movable contact extending along the adjacent side wall;

an electromagnet received within the enclosure, said electromagnet having a coil means the entire length of which is completely surrounded by said enclosure to be thereby insulated from the contact assembly;

a flat armature which is mounted on the top wall of the enclosure to be movable within a plane parallel to the plane of the base;

said armature having at its rear end pole means which extends through a window in the rear portion of the top wall into the enclosure where it is magnetically coupled with a pole end at the rear end of the electromagnet for movement on the top wall upon energization of the electromagnet; and said armature including at least one card of electrically insulative material which extends sidewards over the side wall of the enclosure to be connected to the movable contact such that the movable contact is driven through the armature for making the switching operation thereof upon energization of the electromagnet.

3. An electromagnetic relay as set forth in claim 1, wherein said electromagnet includes a coil bobbin around which coil means is wound, said coil bobbin being formed at its front end with a flange which carrier coil terminals for the coil means; and wherein said enclosure is formed with at least one insulation lip which extends sidewards and outwardly from the front end of the side wall adjacent to said contact assembly, said enclosure forming on the front of the insulation lip a recess for receiving therein said flange of the coil bobbin such that the coil terminals on the flange are insulatively separated by the insulation lip from the contact assembly disposed rearwardly of the insulation lip.

4. An electromagnetic relay as set forth in claim 1, wherein said electromagnet includes a U-shaped yoke with parallel legs which are magnetized by the energization of the coil and define therebetween a gap within which the pole means of the armature moves in response to the energization of the electromagnet; the outer face of each yoke leg being kept in intimate contact with the inner surface of the adjacent side wall of the enclosure such that the legs of the yoke are kept in a fixed position to maintain said gap at a predetermined distance.

5. An electromagnetic relay as set forth in claim 1, wherein said electromagnet includes a coil bobbin carrying thereabout a set coil and a reset coil, three coil terminals one being common to the set and reset coils and the two others each connected to each one of the set and reset coils, said coil bobbin being formed at its front end with a flange which carries two of the coil terminals; and wherein said enclosure is formed with at least one insulation lip which extends sidewards and outwardly from the front end of the side wall adjacent to said contact assembly, said enclosure forming on the front of the insulation lip a recess for receiving therein said flange of the coil bobbin such that the two coil terminals held on the flange is insulatively separated by the insulation lip from the contact assembly disposed rearwardly of the insulation lip, and said insulation lip being provided in its front surface with an indent for receiving the remaining coil terminal so as to insulatively separate the latter coil terminal from the contact assembly disposed rearwardly of the insulation lip.

6. An electromagnetic relay as set forth in claim 1, further including a cover of electrically insulative material which fits over the armature and the contact assembly on the base, said base being provided with support wall means which extends upwardly above the armature to be in supporting contact with the ceiling of the cover.

7. An electromagnetic relay as set forth in claim 1, wherein said card is formed with a slot through which said movable contact extends for driving connection with the card, said movable contact extending through the slot in a loose manner such that the movable contact is brought into abutting engagement with one of the opposed faces of the slot when the armature drives the movable contact to move the same in the direction of making the contact and that the movable contact is brought into abutting engagement with the other face of the slot when the armature drives the movable contact to move the same in the opposite direction of breaking the contact against the bias of the movable contact, and said other face of the slot being configured to have a flat portion in face-to-face contacting engagement with the part of the movable contact with respect to its length.

8. An electromagnetic relay comprising:

a mount base of electrically insulative material provided with an intergrally molded enclosure having a top wall and side walls, said top wall and side walls cooperating with a portion of the mount base to define said enclosure to be of a tunnel-like configuration contiguous around its periphery;

a pair of contact assemblies mounted on the base outwardly of the enclosure and adjacent each of the side walls thereof, such contact assembly including a movable contact extending along the adjacent side wall;

an electromagnet received within the enclosure, said electromagnet having a coil means the entire length of which is completely surrounded by said enclosure to be thereby insulated from the contact assembly;

a flat armature which is mounted on the top wall of the enclosure to be movable within a plane parallel to the plane of the base;

said armature being provided at its rear end with a pole end which extends through a window in the rear end portion of the top wall into the enclosure where it is magnetically coupled with the rear end of the electromagnet for movement on the top wall upon energization of the electromagnet; and said armature having a either side thereof a card of electrically insulative material which extends over the adjacent side wall of the enclosure to be connected to the movable contact of each contact assembly such that the movable contacts are driven by the armature for making the switching operation thereof upon energization of the electromagnet.

9. An electromagnetic relay comprising a mount base of electrically insulative material provided with an integrally molded enclosure having a top wall and side walls, said top wall and side walls cooperating with a portion of the mount base to define said enclosure to be of a tunnel-like configuration contiguous around its periphery;

a single contact assembly mounted on the base laterally outwardly of side wall of the enclosure, said contact assembly including a movable contact in the form of an elongate spring;

an electromagnet received within the enclosure, said electromagnet having a coil means the entire length of which is completely surrounded by said enclosure to be thereby insulated from the contact assembly;

an armature being pivotally supported on the top wall of the enclosure to be movable about a pivot pin vertically projecting on the top wall so as to be movable within a plane parallel to the base and magnetically coupled to the electromagnet for movement in response to energization of the electromagnet;

said armature being provided with a card of electrically insulative material which extends over the side wall of the enclosure to be connected to the movable spring such that the movable spring is driven through the card for making the switching operation thereof in response to said energization of the electromagnet; and said pivot pin being located at a position which is outside of the length of the movable spring but is aligned on an imaginary extension line thereof.

* * * * *